United States Patent [19]

Blotenberg

[11] Patent Number: 4,948,332

[45] Date of Patent: Aug. 14, 1990

[54] METHOD OF PREVENTING SURGE IN A TURBOCOMPRESSOR BY REGULATING BLOW-OFF

[75] Inventor: Wilfried Blotenberg, Dinslaken, Fed. Rep. of Germany

[73] Assignee: MAN Gutehoffnungshütte AG, Oberhausen, Fed. Rep. of Germany

[21] Appl. No.: 321,519

[22] Filed: Mar. 9, 1989

[30] Foreign Application Priority Data

Mar. 30, 1988 [DE] Fed. Rep. of Germany ..... 3810717

[51] Int. Cl.[5] ..... F04D 27/02

[52] U.S. Cl. ..... 415/27; 415/47

[58] Field of Search ..... 415/1, 17, 26, 27, 28, 415/13, 47; 60/39.29; 417/310, 282, 292

[56] References Cited

U.S. PATENT DOCUMENTS

| | | | |
|---|---|---|---|
| 4,139,328 | 2/1979 | Kuper et al. | 415/27 |
| 4,464,720 | 8/1984 | Agarwal | 415/1 |
| 4,486,142 | 12/1984 | Staroselsky | 415/27 |
| 4,560,319 | 12/1985 | Blotenberg | 415/26 |
| 4,656,589 | 4/1987 | Albers et al. | 415/17 |
| 4,697,980 | 10/1987 | Keyes, IV et al. | 415/1 |
| 4,749,331 | 6/1988 | Blotenberg | 415/47 |
| 4,781,524 | 11/1988 | Blotenberg | 415/27 |
| 4,789,298 | 12/1988 | Blotenberg | 415/27 |
| 4,796,213 | 1/1989 | Blotenberg | 415/26 |
| 4,831,534 | 5/1989 | Blotenberg | 415/1 |
| 4,831,535 | 5/1989 | Blotenberg | 415/17 |

FOREIGN PATENT DOCUMENTS

| | | | |
|---|---|---|---|
| 319849 | 6/1989 | European Pat. Off. | 60/39.29 |
| 1021797 | 3/1966 | United Kingdom | 415/27 |

*Primary Examiner*—Edward K. Look
*Assistant Examiner*—John T. Kwon
*Attorney, Agent, or Firm*—Max Fogiel

[57] ABSTRACT

A method for preventing surges in a turbocompressor which supplies downstream processor with a gaseous medium by regulating a blow-off valve. The compressor volumetric intake flow is continuously measured, as is the compressor outlet pressure. A first minimum is designated to the compressor volumetric intake flow, and this minimum is dependent on the compressor outlet pressure. The blow-off valve is opened to ensure that the volumetric intake flow of the compressor remains above a surge limit when the intake flow drops to or below the first minimum and to a value that is still permissible and above the surge limit. The flow to the processor downstream is measured separately and in vicinity of the processor intake. The blow-off valve is also opened when the flow to the processor drops below a permissible second mininum value. The compressor intake flow is measured in vicinity of the compressor intake, whereas the flow to the processor is measured separately in vicinity of the processor intake. Each measuring location detects first any operating disturbances that originate at the respective location, so that the disturbances are detected quickly independent of the location where they originate.

16 Claims, 8 Drawing Sheets

METHOD OF PREVENTING SURGE IN A TURBOCOMPRESSOR BY REGULATING BLOW-OFF

The invention concerns a method of preventing surge in a turbocompressor, which supplies a downstream processor with a gaseous medium, by regulating blow-off, whereby the volumetric intake flow and the compressor-outlet pressure are continuously determined and, when the volumetric intake flow drops to or below a minimum volumetric intake flow that depends on the compressor-outlet pressure, that is still permissible, and that is above the volumetric surge-limit flow, at least one blow-off valve is opened to ensure that the volumetric flow through the compressor remains above its surge limit.

A method of this type is known from German AS 2 623 899. This method allows the compressor to operate as near its surge limit as possible by specially increasing the blow-off-regulation difference, which depends on the volumetric intake flow and the compressor-outlet pressure, as a function of the particular position of the compressor's operating point.

The position of the compressor's operating point is conventionally defined by the coordinates "volumetric intake flow" and "compressor-outlet pressure" within the performance field they constitute. The compressor's surge limit can be represented in the performance field by a curve, the "surge-limit curve", which the operating point must not exceed while the compressor is in operation. If the operating point shifts, as the volumetric intake flow drops to the surge limit for example, a blow-off curve that is in front of and parallel with the surge-limit curve will be exceeded, and the blow-off valve will open to increase the volumetric intake flow again until the operating point is far enough away from the surge-limit curve.

The etiology of the shifts in the operating point indicates that they are caused not only by fluctuations in the speed of the compressor or by variations in the position of its baffle, but often by changes or malfunctions in the process downstream of the compressor. Any fluctuation in the flow will accordingly initially occur within the process itself in the last-mentioned situation, whence it will propagate as far as the compressor at terminal speed and through the compressor to its intake end. One drawback to the known method in this situation it that the shift in the operating point cannot be detected until the volumetric flow through the compressor has already dropped. Blow-off regulation can accordingly be initiated only after a delay and will be too late when conditions are unfavorable to prevent the compressor from surging.

The object of the present invention is accordingly to provide a method of the aforesaid type wherein the compressor can be reliably prevented from surging even when the cause of the fluctuation in the volumetric intake flow is in the downstream process.

This object is attained in accordance with the invention in a method of the aforesaid type that is characterized in that the outflow to the process downstream of the compressor is determined in the vicinity of its entry and the blow-off valve is opened when the outflow drops below a permissible minimum outflow.

The new method makes it possible to detect in plenty of time fluctuations in flow that derive from changes or malfunctions in the process and to initiate the blow-off regulation when the outflow drops to an extent hazardous to the compressor. This approach reliably prevents a drop in the flow through the compressor that could cause it to surge. The compressor can accordingly be operated closer to the surge limit without sacrificing protection against surge, allowing the compressor to be operated at partial loads and reducing the risk of damage from surging.

The outflow can be measured directly with an appropriate instrument in a compressed-medium pressure line leading to the process. The outflow can also be calculated by means of a simulation involving parameters derived from the downstream process, such as the states of one or more valves and/or the pressures at one or more points in the process. The former version is especially practical when there is already a flowmeter positioned at an appropriate point for other purposes and emitting results that can be exploited for the new method. Calculation is to be preferred when a flowmeter would have to be installed especially for use with the new method. This avoids unnecessarily high investment costs. No matter how the outflow is measured, by an instrument or by calculation, it can be measured with a precision that is sufficient for the method. If the outflow is measured in the form of a mass flow, as mass per unit of time, that is, an additional calculation must be carried out in order to ensure that the same units are employed for the volumetric intake flow and the outflow. The relationship between the mass flow and the volumetric flow is constant by way of the density of the compressed gas, and the density is also a function of pressure. Given this situation, not only must the mass flow be measured, but the pressure at the point of entry into the process must also be measured and the result converted in order to calculate the outflow in the form of a volumetric flow.

As previously mentioned herein, the still just permissible minimum volumetric intake flow is a function of the compressor-outlet pressure. The same is true of the minimum outflow subject to the often existing condition that the pressure of the compressed medium remains essentially constant as it travels toward the process. In one simple embodiment of the invention accordingly, the same minimum-flow value, obtained from a common function generator in accordance with the compressor-outlet pressure is employed for the minimum volumetric intake flow and for the minimum outflow. Another and slightly more complicated version of the method ensures that the method will have greater precision and can be regulated more flexibly in that independently calculated minimum-flow values, each obtained from a separate function generator are employed, one for the minimum volumetric intake flow and the other for the minimum outflow, with the minimum volumetric intake flow being determined as a function of the compressor-outlet pressure and the minimum outflow as a function of the pressure at the point in the vicinity of the entry into the process where the outflow is measured.

In the event that the method includes a safety procedure that predominates over the blow-off regulation system and supersedes it, rapidly opening the blow-off valve when a threshold-of-safety volumetric flow that depends on the compressor-outlet pressure and is positioned between the minimum volumetric intake flow and the volumetric surge-limit flow is not attained, the safety procedure can be activated when the outflow drops below the threshold-of-safety volumetric flow. In this version of the method, accordingly, the flow values detected at the outflow end affect both the blow-off regulation system and the safety procedure.

It is, however, also possible to use the minimum-flow values that correspond to the particular threshold-of-safety volumetric flow for the minimum outflow and for the safety procedure to supersede the blow-off regulation system and rapidly open the blow-off valve when the outflow drops below the minimum outflow. Malfunctions in the outflow will accordingly affect the safety procedure and not the normal blow-off regulation system. This subsidiary version of the method actually represents no diminution in the compressor's anti-surge protection because, in the event of small and/or slow changes or malfunctions in the outflow, the normal blow-off regulation system, which depends on the volumetric intake flow can still respond rapidly enough.

To make it possible to utilize the new method with sufficient precision even when the compressor is operating with the blow-off valve open, the flow through the blow-off valve can also be measured and added to the outflow. The flow through the blow-off valve can either be measured by an instrument in the blow-off line upstream and downstream of the blow-off valve or by calculation, eliminating the need for a special instrument. One means of calculating the flow through the blow-off valve is by simulation employing the state of the blow-off valve and the pressure upstream of the blow-off valve. This approach requires a sensor to sense the state of the blow-off valve, a component that is often already present for other purposes. When a state sensor of this type is not included, the flow through the blow-off valve can be calculated by simulating the dynamic behavior of the blow-off valve from a parameter that is generated during blow-off regulation to adjust the blow-off valve and from the pressure upstream of the blow-off valve. This type of simulation of the dynamic behavior of a valve is no problem at the present state of development of electronic data processing.

To obtain higher precision in measuring the flow through the blow-off valve, the temperature of the medium flowing through the blow-off valve and/or the pressure downstream of the blow-off valve are measured and introduced into the calculation of the flow through the blow-off valve. In addition to temperature and/or pressure, other parameters that affect the flow through the blow-off valve can be detected and included in the calculation.

Residual imprecision in the measurement or calculation of the outflow and possibly of the flow through the blow-off valve can cause the measured flow to be lower than the actual flow. In this case the blow-off valve might be primarily controlled by way of changes in the flow through the blow-off valve or by way of the sum of these and of the outflow. This, however, would lead to operating the compressor unnecessarily far away from the surge limit. To prevent this situation, the outflow or the sum of the outflow and the flow through the blow-off valve can be multiplied before it participates in the regulation or safety procedure by a prescribed factor that is greater than one. As an alternative and for the same purpose, a prescribed constant can be added to the outflow or to the sum of the outflow and the flow through the blow-off valve before they participate in the regulation of the safety procedure. In consequence, the distance of the operating point from the surge limit will undesirably increase beyond the limits of safety only when the error in determining the outflow is greater, 1.2 for example, than the prescribed factor or added constant.

In another embodiment of the invention, a correction parameter is added to the outflow or to the sum of the outflow and the flow through the blow-off valve in a subsidiary device with a greater time constant and is varied until the sum of the outflow and the flow through the blow-off valve precisely equals the volumetric intake flow. The time constants in the subsidiary device, which can for example be an integrator, can be selected to ensure that the compensation occurs slowly enough for temporary dynamic disequilibriums between the volumetric intake flow and the outflow or the sum of the outflow and the flow through the blow-off valve and between the associated regulation differences to pass through unimpeded. The integrator can also be limited to specific values, especially negative values, to prevent establishment of a safe distance from the surge limit that is too long.

In another embodiment of the method, the values of the outflow or of the sum of the outflow and the flow through the blow-off valve can be provided to a yielding reference device consisting essentially of an integrator with an adjustable time constant and with an output signal that follows its input signal subsequent to that time constant, whereby the temporary difference between the input signal and the output signal that occurs subsequent to sudden changes in the input signal is employed as a parameter to correct a regulation difference that is constructed from the volumetric intake flow and the minimum volumetric intake flow and participates in normal blow-off regulation. Thus, in the event of a sudden drop in the outflow, an earlier and/or more powerful intervention in the normal blow-off regulation system can be initiated. The regulation difference can simultaneously be changed either directly and on its own or by switching the correction parameter in accordance with mathematical sign to either the reference value or the actual value employed to calculate the regulation difference. Since an early response of this type is unnecessary for malfunctions in the sense of an increased outflow, it is more practical for the regulation to be embodied in the form of a yielding reference device that acts only in the event of a drop.

Finally, it is also possible to measure the outflow in the form of several individual fractional outflows at various points in the vicinity of potential sites of malfunction in the process downstream of the compressor, whereby a separate minimum-flow value is calculated independently for each fractional outflow by a separate function generator in accordance with the prevailing compressor-outlet pressure. Although this approach is admittedly more expensive, it will ensure the earliest possible response on the part of the blow-off regulation system and/or the safety procedure to malfunctions in the downstream process.

BRIEF DESCRIPTION OF THE DRAWINGS

FIG. 3(*b*) is a schematic view of a fourth embodiment, in accordance with the present invention;

FIG. 3(*c*) is a schematic view of a fifth embodiment, in accordance with the present invention;

Figure 1:
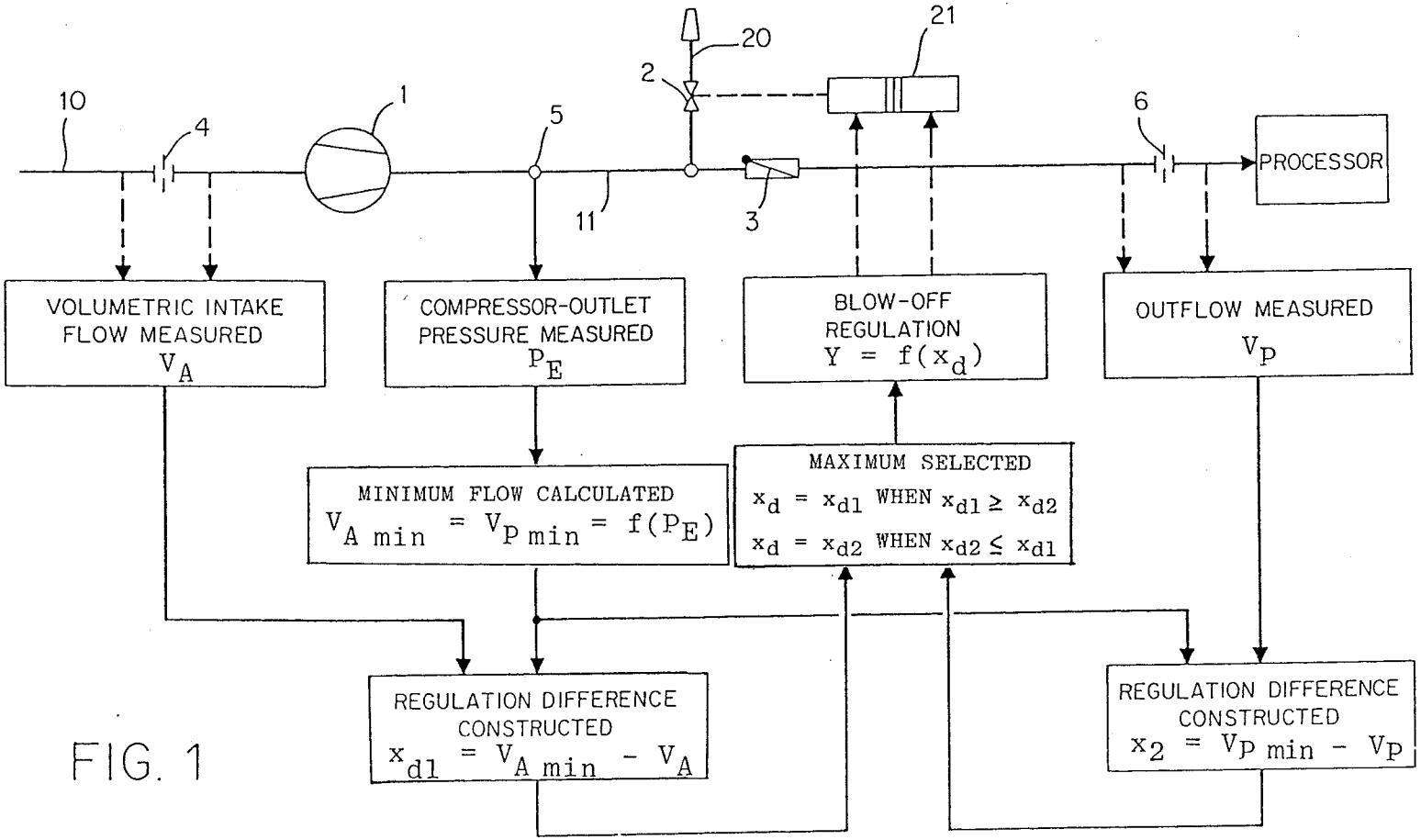
FIG. 1 is a schematic view of a first embodiment, in accordance with the present invention.
Figure 2:
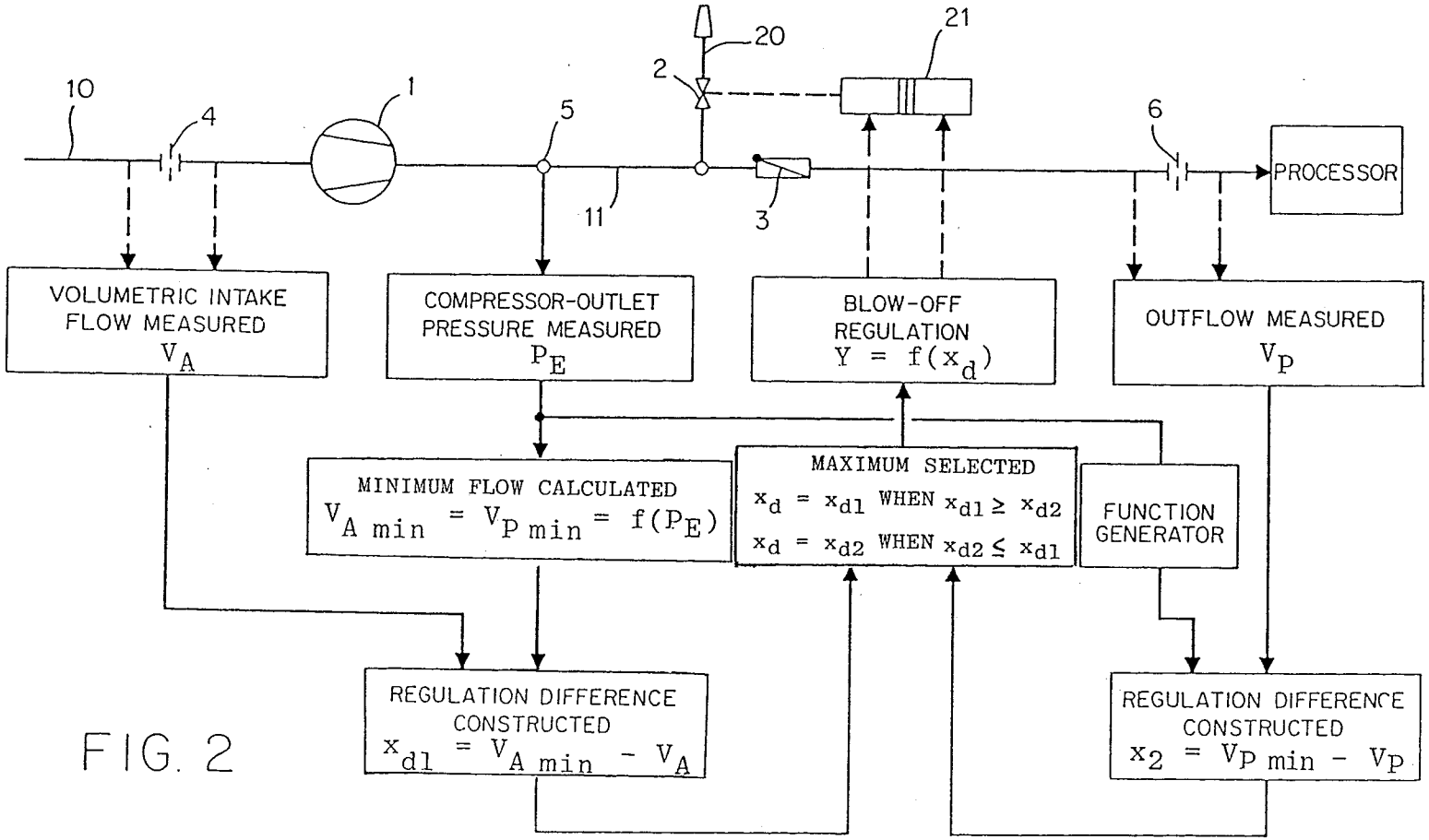
FIG. 2 is a schematic view of a second embodiment, in accordance with the present invention.
Figure 3A:
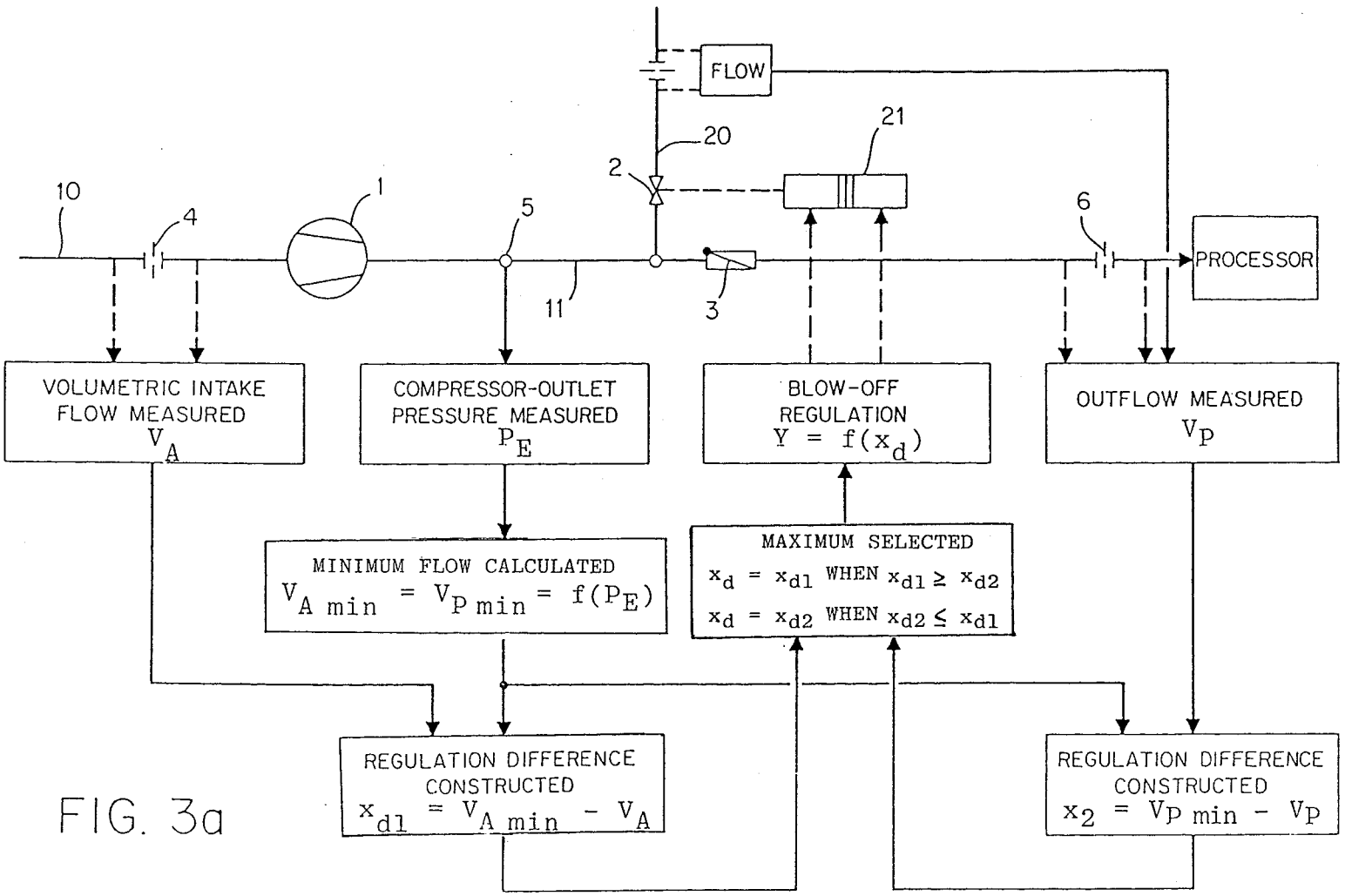
FIG. 3(*a*) is a schematic view of a third embodiment, in accordance with the present invention.
Figure 3B:
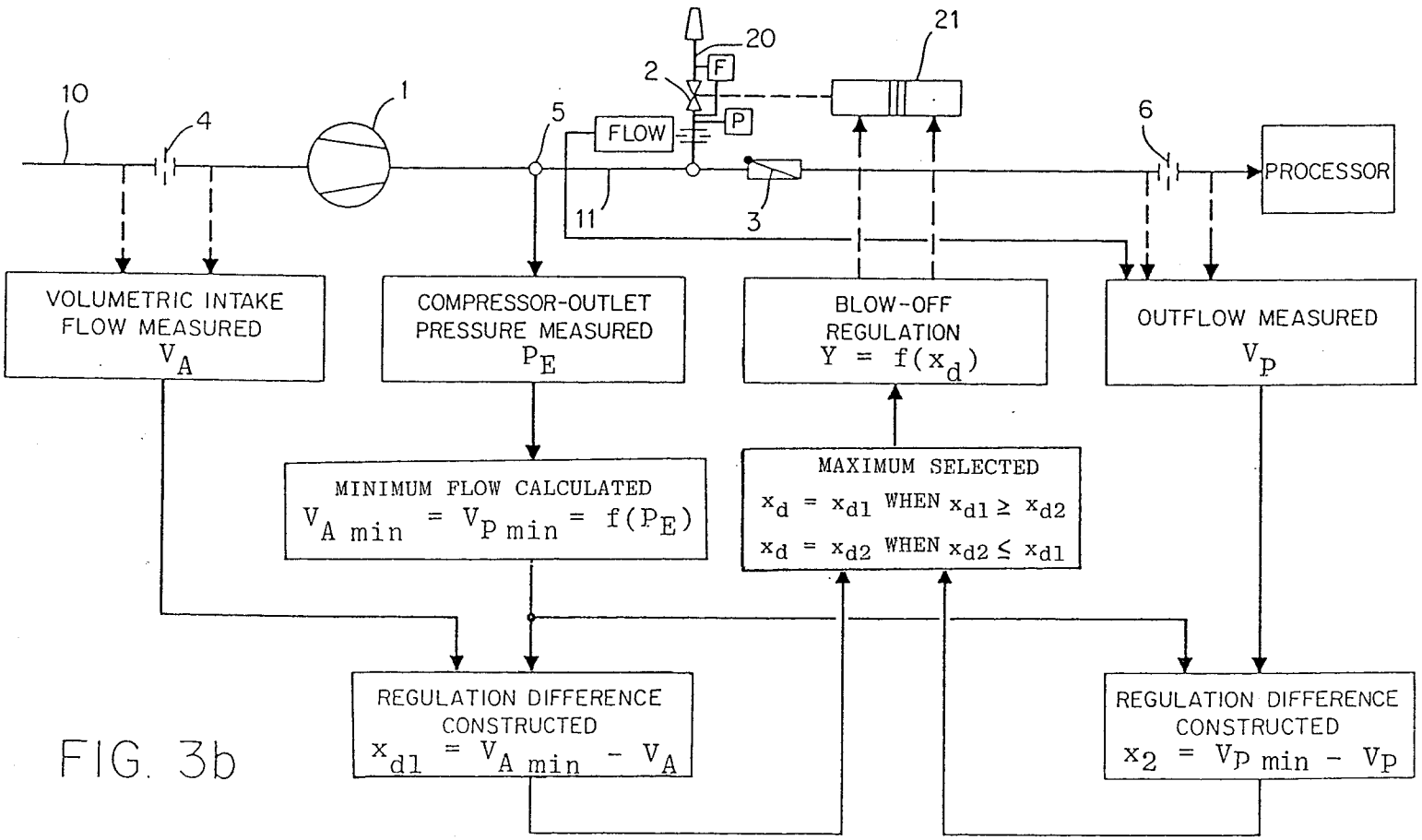
Figure 3C:
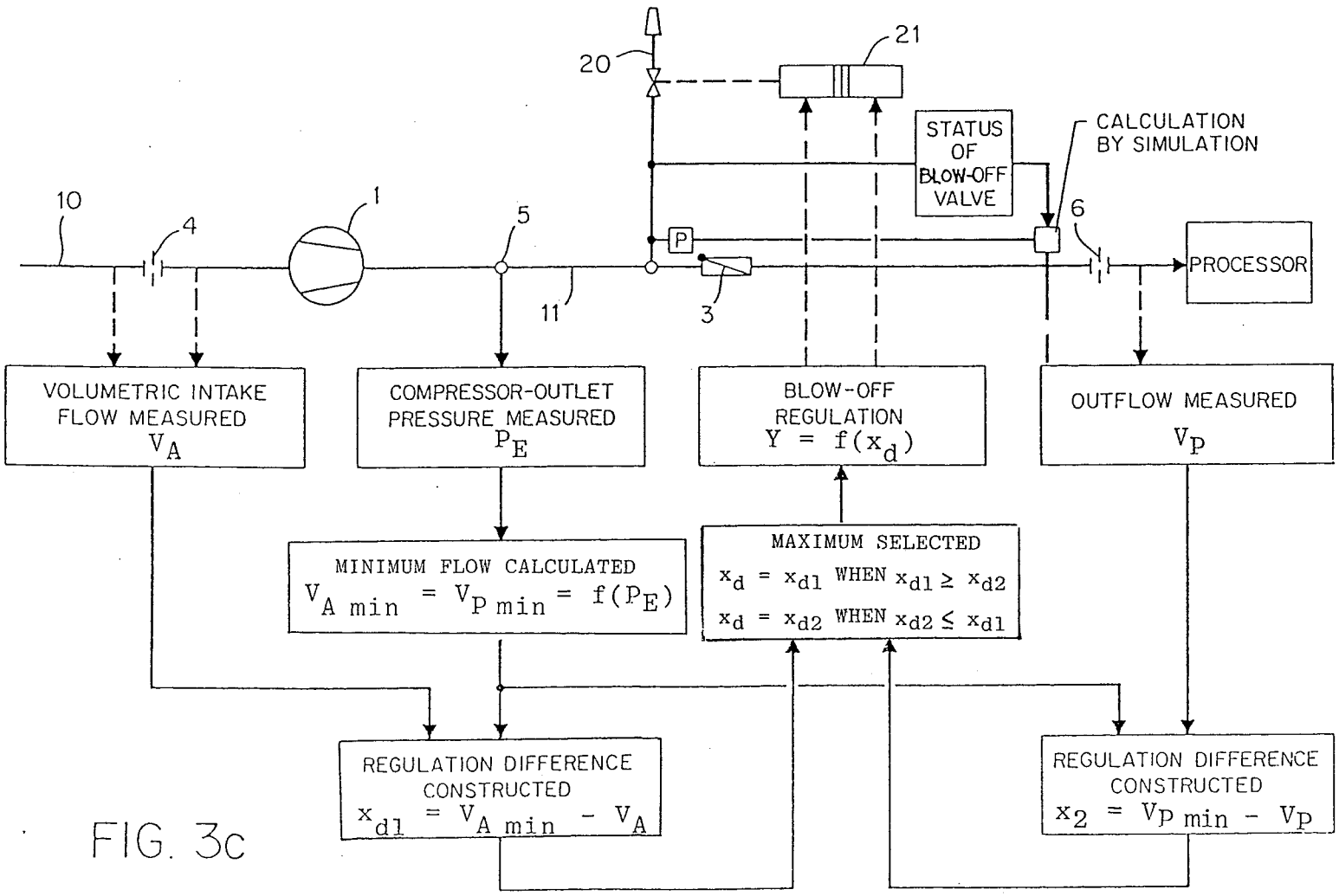
Figure 4:
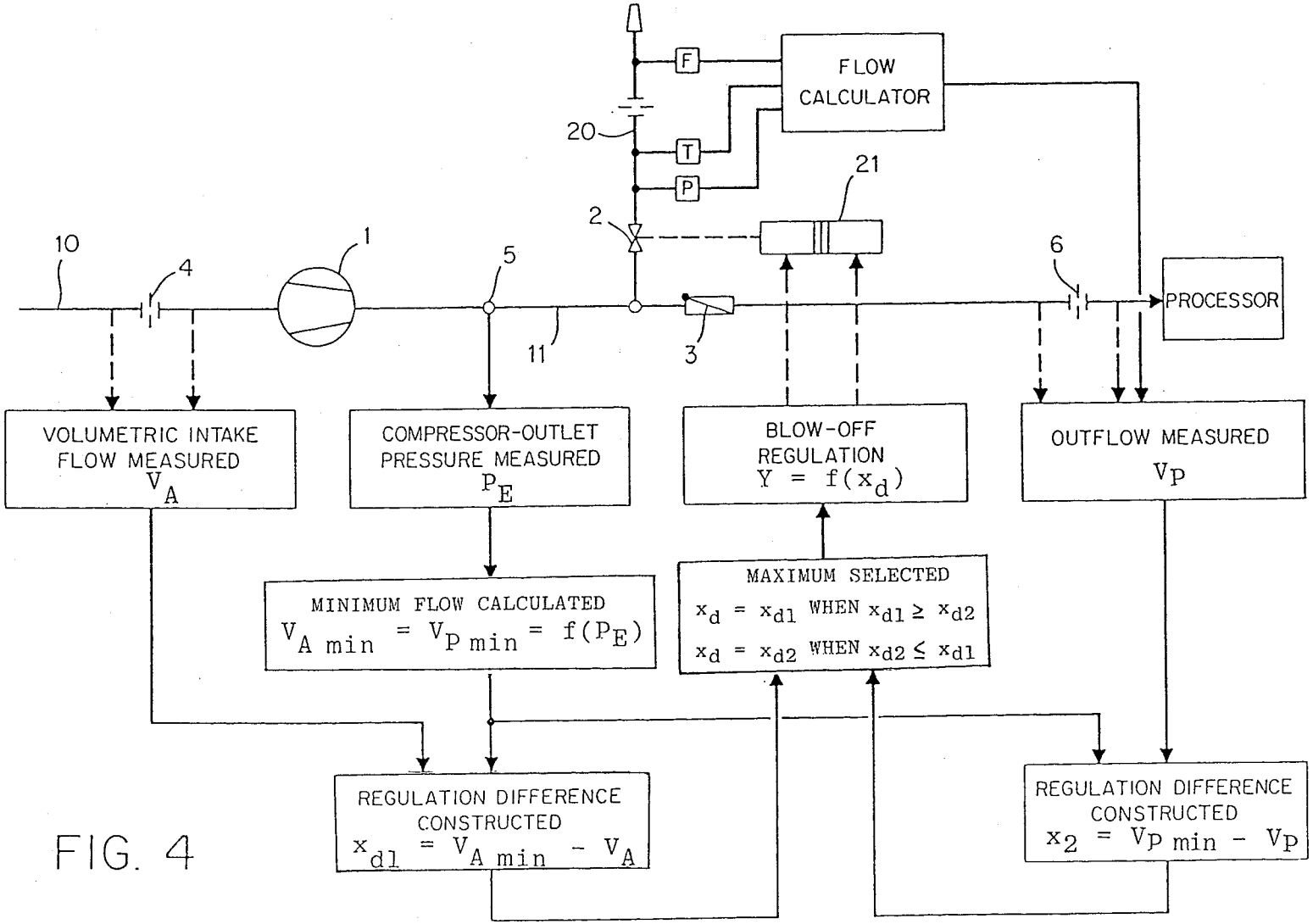
FIG. 4 is a schematic view of a sixth embodiment, in accordance with the present invention.
Figure 5:
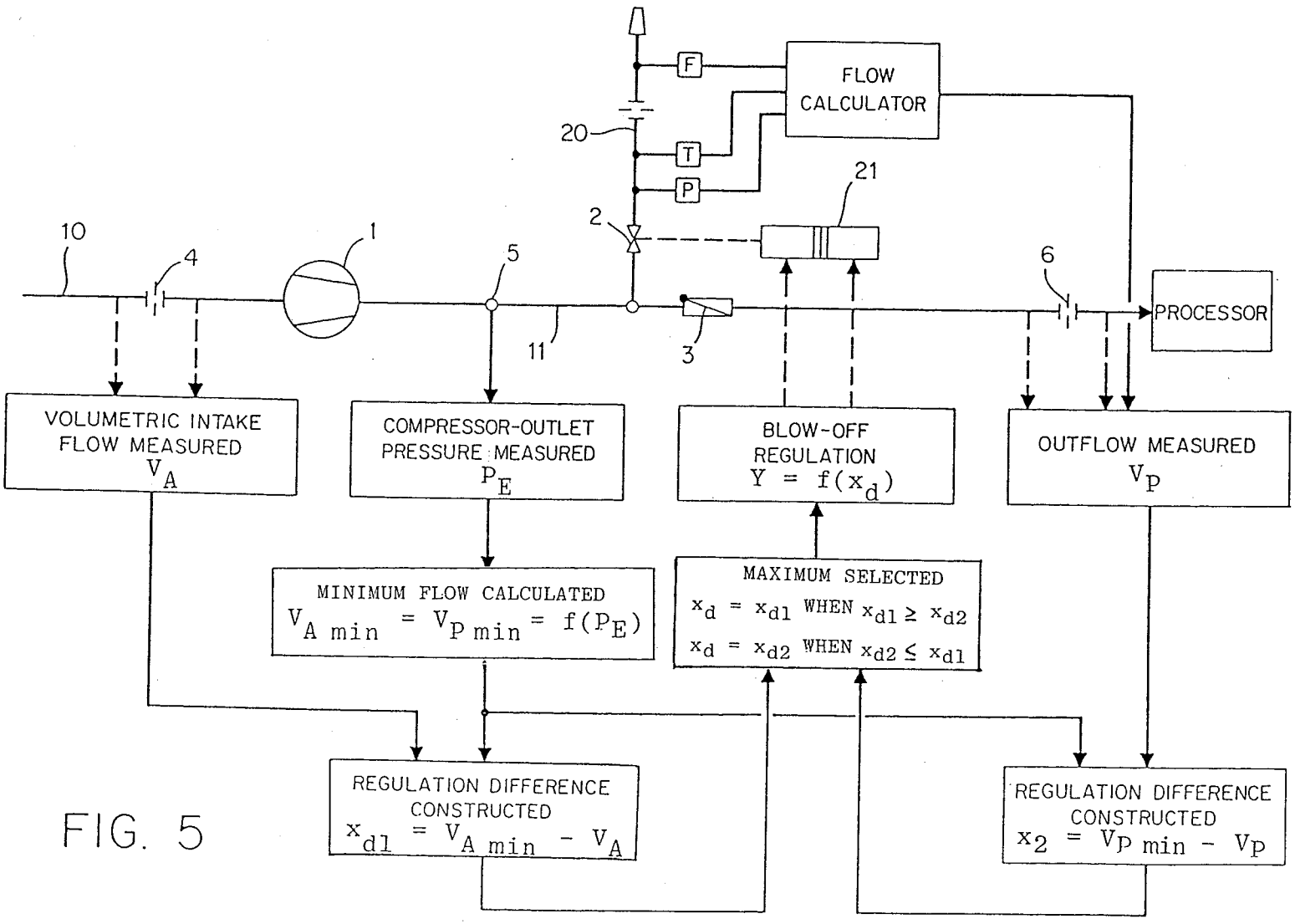
FIG. 5 is a schematic view of a seventh embodiment, in accordance with the present invention.
Figure 6:
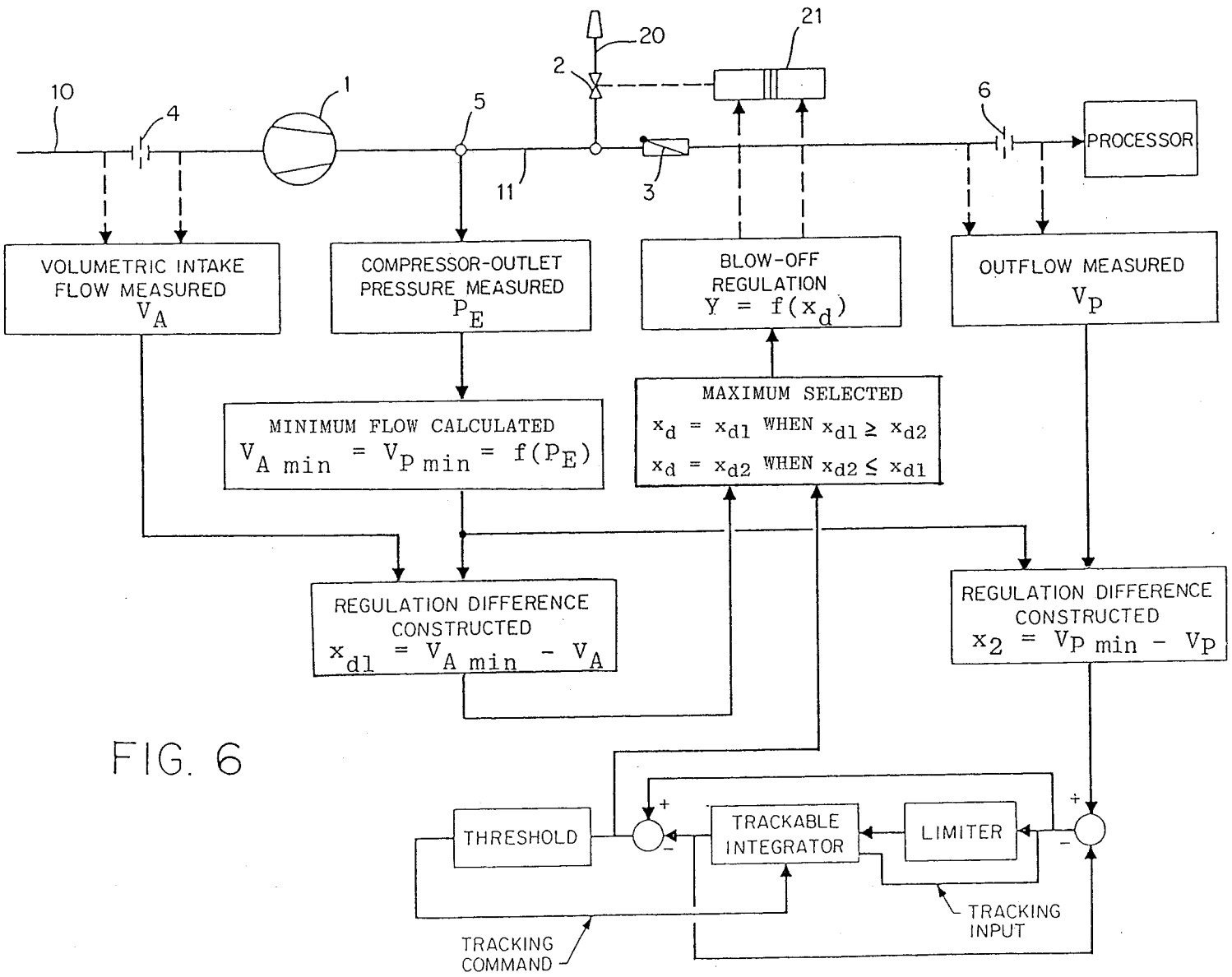
FIG. 6 is a schematic view of a eighth embodiment, in accordance with the present invention.

At the top of the figure is a turbocompressor 1 that communicates at the intake end with an intake line 10 and at the outlet end with an outlet line 11. Branching off of outlet line 11 is a blow-off line 20 that accommodates a blow-off valve 2. When blow-off valve 2 is open, some of gaseous medium arriving in outlet line 11 from compressor 1 can be blown off into the atmosphere. Blow-off valve 2 can for this purpose be adjusted with a valve activator 21. The subsequent section of outlet line 11 conventionally accommodates a check valve 3. Subsequent to check valve 3, outlet line 11 leads to a process downstream of compressor 1, which supplies it with the compressed gaseous medium.

Upstream of compressor 1 in intake line 10 is an instrument 4 that measures the volumetric intake flow $V_A$ through intake line 10 to compressor 1. Downstream of compressor 1 in outlet line 11 is another measuring instrument 5 that measures the compressor-outlet pressure $P_E$. Upstream of the process that is downstream of compressor 1 is a third instrument 6 in outlet line 11 that measures the outflow $V_P$ to the process. The density of the medium at the point of detection can be converted into volume per unit of time if the outflow is measured as a mass flow, in terms of mass per unit of time, that is.

As will be evident from the flow chart, the results of the measurements of compressor-outlet pressure $P_E$ are employed to calculate the just permissible minimum flow $V_{A\,min}$ at a particular pressure $P_E$. This is followed by calculation of a regulation difference $x_{d1}$, defined as the difference between the minimum flow, minimum volumetric intake flow $V_{A\,min}$ in this case, and volumetric intake flow $V_A$. The results of the measurement of outflow $_{VP}$ are employed to calculate another regulation difference $x_{d2}$, defined as the difference between the minimum flow, minimum outflow $V_{P\,min}$ in this case, and measured outflow $V_P$. Since the same minimum flow is employed to construct both regulation differences in the present example, minimum volumetric intake flow $V_{A\,min}$ will equal minimum outflow $V_{P\,min}$. A separate minimum outflow can as an alternative be calculated.

The maximum of the two regulation differences $x_{d1}$ and $x_{d2}$ is then selected and supplied as a regulation difference $x_d$ for regulating blow-off. From the regulation difference $x_d$ supplied to it, the blow-off regulation system calculates a parameter y that is forwarded to the aforementioned valve activator 21 to be employed in appropriately adjusting blow-off valve 2.

It will be obvious from the flow chart of this simple embodiment of the invention that, when the flow changes due to an event that occurs in the process downstream of compressor 1, outflow $V_P$ will be varied before volumetric intake flow $V_A$ can change. Any such change will be detected in plenty of time by measuring instrument 6, leading, due to the construction of the regulation difference, the selection of a maximum, and the regulation of blow-off, to a response on the part of blow-off valve 2 that will be early and hence in plenty of time, even when the instrument 4 that measures volumetric intake flow $V_A$ has still not detected any change in the flow, to reliably prevent the compressor from surging.

I claim:

1. A method for preventing surges in a turbocompressor supplying a downstream processor with a gaseous medium by regulating blow-off, comprising the steps: measuring continuously compressor volumetric intake flow and compressor outlet pressure, said compressor volumetric intake flow having a first minimum dependent on the compressor outlet pressure; opening at least one blow-off valve to ensure that volumetric intake flow of the compressor remains above a surge limit when the compressor volumetric intake flow drops to or below said first minimum and to a value that is still permissible and above the surge limit of the compressor volumetric intake flow; measuring flow to said downstream processor in vicinity of the processor intake; and opening sand blow-off valve when said flow to said processor drops below a permissible second minimum value, said compressor intake flow being measured in vicinity of the compressor intake and being a separately measured flow from said flow to said processor; operating disturbances originating at the processor side being detected first by said step of measuring flow to said processor, and disturbances originating at the compressor side being detected first by said step of measuring said compressor volumetric intake flow.

2. A method as defined in claim 1, including the step of calculating from a simulation said flow to said processor by involving parameters derived characteristics present in the flow from said compressor to said processor.

3. A method as defined in claim 1, including the step of generating said first minimum and said second minimum by a common function generator in accordance with the compressor outlet pressure.

4. A method as defined in claim 1, including the step of generating independent values for said first minimum and said second minimum by separate function generators; determining said first minimum as a function of said compressor outlet pressure; and determining said second minimum as a function of pressure at a point in vicinity of where the flow to said processor is measured.

5. A method as defined in claim 1, including the step of activating a safety procedure when said flow to said processor drops below a threshold-off-safety volumetric flow dependent on the compressor outlet pressure, said threshold-off-safety volumetric flow being between said first minimum and a volumetric surge-limit flow, said safety procedure predominating over the blow-off regulation for rapidly opening the blow-off valve when said threshold-off-safety volumetric flow is not attained.

6. A method as defined in claim 5, wherein said second minimum corresponds to said threshold-off-safety volumetric flow, said safety procedure superceding the blow-off regulation and opening rapidly said blow-off valve when the flow to said processor drops below said second minimum.

7. A method as defined in claim 5, including the step of multiplying at least said flow to said processor by a predetermined factor greater than one before said flow to said processor participates in said blow-off regulation or said safety procedure.

8. A method as defined in claim 5, including the step of adding a predetermined constant to at least said flow to said processor before participating in said blow-off regulation or said safety procedure.

9. A method as defined in claim 1, including the step of measuring flow through said blow-off valve and adding it to a measuring outlet flow device.

10. A method as defined in claim 9, including the step of calculating the flow through said blow-off valve by simulation dependent on the state of said blow-off valve and pressure upstream of said blow-valve.

11. A method as defined in claim 10, including the step of measuring temperature of the flow through said blow-off valve and pressure downstream of said blow-off valve for said calculating step.

12. A method as defined in claim 9, including the step of calculating the flow through said blow-off valve by simulating dynamic behavior of said blow-off valve from a parameter generated during blow-off regulation to adjust the blow-off valve and from pressure upstream of said blow-off valve.

13. A method as defined in claim 12, including the step of measuring temperature of the flow through said blow-off valve and pressure downstream of said blow-off valve for said calculating step.

14. A method as defined in claim 1, including the step of adding a correction parameter to at least said flow to said processor in subsidiary means with a greater time constant; and varying said correction parameter until the sum of said flow to said processor and the flow through said blow-off valve equals precisely said compressor volumetric intake flow.

15. A method as defined in claim 1, including the step of transferring values of at least the flow to said processor to a reference means comprising substantially an integrator with an adjustable time constant and having an output signal following an input signal to said integrator subsequent to said time constant; and correcting a regulation difference by a temporary difference between said input signal and said output signal occurring subsequent to sudden changes in said input signal, said regulation difference being formed from said compressor volumetric intake flow and said first minimum and participating in normal blow-off regulation.

16. A method as defined in claim 1, wherein said step of measuring the flow to said processor comprises further the step of measuring a plurality of individual fractional flows at a plurality of points in vicinity of potential sites of malfunction in the flow downstream of said compressor; and calculating a separate minimum-flow value independently for each fractional outflow by a separate function generator in accordance with the prevailing compressor outlet pressure.

* * * * *